US011512435B2

(12) United States Patent
White

(10) Patent No.: US 11,512,435 B2
(45) Date of Patent: Nov. 29, 2022

(54) SYSTEM FOR AND METHOD OF STABILIZING RAIL TRACK STRUCTURES USING A LOAD TRANSFER APPARATUS

(71) Applicant: Geopier Foundation Company, Inc., Davidson, NC (US)

(72) Inventor: David J. White, Davidson, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 363 days.

(21) Appl. No.: 16/706,915

(22) Filed: Dec. 9, 2019

(65) Prior Publication Data

US 2020/0115857 A1 Apr. 16, 2020

Related U.S. Application Data

(63) Continuation of application No. 14/916,737, filed as application No. PCT/US2014/053985 on Sep. 4, 2014, now Pat. No. 10,501,893.

(Continued)

(51) Int. Cl.

| | |
|---|---|
| ***E01B 2/00*** | (2006.01) |
| ***E02D 5/46*** | (2006.01) |
| ***E02D 3/08*** | (2006.01) |
| ***E01B 1/00*** | (2006.01) |
| ***E02D 5/22*** | (2006.01) |

(Continued)

(52) U.S. Cl.

CPC ..... *E01B 2/006* (2013.01); *E01B 1/001* (2013.01); *E02D 3/08* (2013.01); *E02D 5/223* (2013.01); *E02D 5/34* (2013.01); *E02D 5/46* (2013.01); *E02D 5/48* (2013.01); *E02D 5/56* (2013.01); *E02D 7/02* (2013.01); *E01B 2204/08* (2013.01)

(58) Field of Classification Search

CPC .... E02D 3/08; E02D 5/56; E02D 7/02; E02D 5/34; E02D 5/48; E02D 5/223; E02D 5/46; E01B 2/006; E01B 1/001; E01B 2204/08

See application file for complete search history.

(56) References Cited

U.S. PATENT DOCUMENTS

| | | | |
|---|---|---|---|
| 4,494,694 | A | 1/1985 | Pitt et al. |
| 5,575,593 | A | 11/1996 | Raff |

(Continued)

FOREIGN PATENT DOCUMENTS

| | | | |
|---|---|---|---|
| EP | 2744942 | B1 | 6/2014 |
| WO | 2013024299 | A1 | 2/2013 |

*Primary Examiner* — Zachary L Kuhfuss

(74) *Attorney, Agent, or Firm* — Nexsen Pruet, PLLC; E. Eric Mills; Todd Allen Serbin

(57) ABSTRACT

A system for and method of stabilizing rail track structures using a load transfer apparatus is disclosed. The load transfer apparatus includes a vertical load transfer element and a top load transfer element, wherein the top load transfer element is used to transfer applied locomotive and rail car loads to the vertical load transfer element. In one embodiment, the top load transfer element includes helical flights. In another embodiment, the top load transfer element includes a flared top. In yet another embodiment, the top load transfer element includes a load transfer cap. In a further embodiment, the top load transfer element includes two or more support legs each with a top support attached thereto. The railroad stabilization system can comprise any one type or any combinations of types of the aforementioned load transfer apparatuses.

26 Claims, 8 Drawing Sheets

Related U.S. Application Data

(60) Provisional application No. 61/874,050, filed on Sep. 5, 2013.

(51) Int. Cl.

| | |
|---|---|
| ***E02D 5/34*** | (2006.01) |
| ***E02D 5/48*** | (2006.01) |
| ***E02D 5/56*** | (2006.01) |
| ***E02D 7/02*** | (2006.01) |

(56) References Cited

U.S. PATENT DOCUMENTS

| | | | | |
|---|---|---|---|---|
| 6,652,195 | B2 * | 11/2003 | Vickars | E02D 5/46 52/169.13 |
| 10,501,893 | B2 * | 12/2019 | White | E02D 5/223 |
| 2001/0028827 | A1 | 10/2001 | Vickars et al. | |
| 2003/0217420 | A1 | 11/2003 | Snead | |
| 2011/0064526 | A1 | 3/2011 | White | |
| 2016/0194833 | A1 | 7/2016 | White | |

* cited by examiner

SYSTEM FOR AND METHOD OF STABILIZING RAIL TRACK STRUCTURES USING A LOAD TRANSFER APPARATUS

CROSS-REFERENCE TO RELATED APPLICATIONS

This application is a continuation and claims priority to U.S. patent application Ser. No. 14/916,737 filed Mar. 4, 2016 entitled "System For And Method Of Stabilizing Rail Track Structures Using A Load Transfer Apparatus" which is a 35 U.S.C. § 371 U.S. National Phase entry of International Application No. PCT/US2014/053985 entitled "System For And Method Of Stabilizing Rail Track Structures Using A Load Transfer Apparatus" having an international filing date of Sep. 4, 2014 which claims the benefit of U.S. Provisional Application Ser. No. 61/874,050 entitled "Method and Apparatus for Stabilizing Rail Track Structures" filed on Sep. 5, 2013; the entire disclosure of which is incorporated herein by reference.

TECHNICAL FIELD

The subject matter disclosed herein relates generally to the stabilization of railroad structures subject to locomotive and rail car loading, and more particularly to a system for and method of stabilizing rail track structures using a load transfer apparatus.

BACKGROUND

Railroad rails or tracks are most often supported by railroad ties (or rail ties) connecting the tracks together and transferring the loads applied by the locomotive and rail cars to the materials below. Rail ties are typically supported by a bed of ballast (e.g., large aggregate) that is placed over the existing ground. The aggregate serves as both a drainage layer and a load support layer.

When railroads are constructed over soft soils, or when deep embankments are required to be constructed for rail grades, the ground below the aggregate can settle or have low stiffness, resulting in too much deformation and permanent settlement of the supported aggregate, rail ties, and rails. Settlement, particularly when non-uniform, and low track modulus often results in the reduction of allowable train speeds causing unwanted economic inefficiency for rail operators and frequent maintenance. Furthermore, problems with settlement and low stiffness are often exacerbated by rainfall. The aggregate tends to "settle into" the underlying soil, forming a curved interface between the bottom of the aggregate and the top of the subgrade with the maximum settlement at or near the center of the rails and less settlement along the outward edges of the ties. Rainwater then percolates through the aggregate and is trapped by the "bathtub" of the curved interface. This water then does not drain quickly and seeps into the underlying soil further softening and weakening this material.

There are many existing methods to stabilize rail beds that have settled. Over-excavation and recompaction is a method in which the rail and ties are removed, the aggregate is removed, and the underlying soft soil is excavated to a depth sufficient to remove the soft and compressible materials. Stronger backfill is then brought in, placed, and compacted, and the rail bed is reconstructed. This method has the disadvantages of being expensive and highly disruptive to existing rail traffic.

Lime and cement stabilization methods have also been used to stabilize the soft materials. Lime and cement slurries are injected from the top or sides of the rail bed to interact with the compressible clay soils, to fill voids in the aggregate, and to add strength and stiffness to the system. These methods have the drawbacks, however, of having a relatively high cost and a relatively high rate of failure because of the difficulty of getting the materials to seep into and mix with the compressible soils.

Drains are also sometimes used to remove water from rail beds. Drains often consist of perforated plastic pipes inserted into the bedding aggregate and "daylighting" onto the side of the rail embankment. This method has the advantage that it is expedient and can be installed from the side of the operating line. However, drains clog and the method provides for a passive rather than an active solution and is not reliable for improving design track modulus.

SUMMARY

A system for stabilizing railroad ties and rails is presented. In some embodiments, the system may include a vertical load transfer element and a top load transfer element such that the vertical load transfer element and top load transfer element transfer the load applied to the railroad ties and rails to less compressible underlying soils. The vertical load transfer element may include a pile made from any one of concrete, steel, timber, or composite material. In certain other embodiments, the vertical load transfer element may include an extensible shell defining an interior for holding granular construction material and defining an opening for receiving the granular construction material into the interior. The shell may also be flexible such that the shell expands laterally outward when granular construction material is compacted in the interior of the shell. The extensible shell typically has a diameter in the range of 3 to 12 inches (7.6 to 30.5 cm).

In some embodiments, the top load transfer element includes helical flights attached to an upper portion of the vertical load transfer element. The helical flights of the top load transfer element typically have a pitch and width configured depending on the size and spacing of the railroad ties.

In certain other embodiments, the top load transfer element may include a load transfer cap attached to an upper portion of the vertical load transfer element. The load transfer cap may be constructed of any one of steel, concrete, aluminum, other metals, plastic, wood, or composite materials. The load transfer cap may have a diameter larger than a diameter of the vertical load transfer element and may further include an upwardly projecting lip around a perimeter thereof for acting as a lateral restraint.

In certain other embodiments, the top load transfer element may include a flared top attached to an upper portion of the vertical load transfer element and extending in a horizontal direction away from a vertical axis of the vertical load transfer element. The flared top may be substantially circular or an articulated shape. The flared top may be constructed of a flexible material, including any one of steel, aluminum, other metals, plastic, or composite materials. The flared top may include one or more vertical slots.

In further embodiments, the top load transfer element may include two or more support legs each with a top support attached thereto and may be constructed of materials similar to the flared top.

Also included in the present disclosure is a method of using the system for stabilizing rail track structures generally discussed above. In some embodiments, a method of stabilizing existing rail track structures is presented, including the steps of (i) identifying a section of rail track structure to be stabilized; (ii) providing one or more load transfer apparatuses wherein the apparatus comprises a vertical load transfer element and a top load transfer element; and (iii) installing the one or more load transfer apparatuses in one or more gaps between adjacent railroad ties within the rail track structure. Where an extensible shell is utilized in the load transfer apparatuses, the method may further include the step of filling the load transfer apparatuses with granular material and compacting the material. Additionally, when the load transfer apparatuses include the flared top, the method may further include the step of driving the load transfer apparatus between the railroad ties such that the flared top is compressed to a substantially oval shape, and then returns to its substantially circular shape once driven to a point below the railroad ties.

In certain other embodiments, for example when ground can be stabilized before the installation of rail track and railroad ties, a method of stabilizing a rail track structure may include the steps of (i) identifying an area to be stabilized on which a railroad track and associated railroad ties will be installed; (ii) providing one or more load transfer apparatuses wherein the apparatus comprises a vertical load transfer element and a top load transfer element; (iii) installing the one or more load transfer apparatuses prior to installing the railroad ties and track, wherein the one or more load transfer apparatuses are installed at certain locations relative to expected locations of the railroad ties; and (iv) installing the railroad ties and track atop the one or more load transfer apparatuses. Where the one or more load transfer apparatuses include an extensible shell defining an interior for holding granular construction material and defining an opening for receiving the granular construction material into the interior, the method may further include the step of filling the load transfer apparatuses with granular material and compacting the material.

Other similar methods may also be employed for existing rail track beds, where installation of one or more load transfer apparatuses begins after the removal of existing rail track and associated railroad ties. After the one or more load transfer apparatuses are installed, the previously removed rail track and associated railroad ties may be re-installed.

BRIEF DESCRIPTION OF THE DRAWINGS

Figure 1:
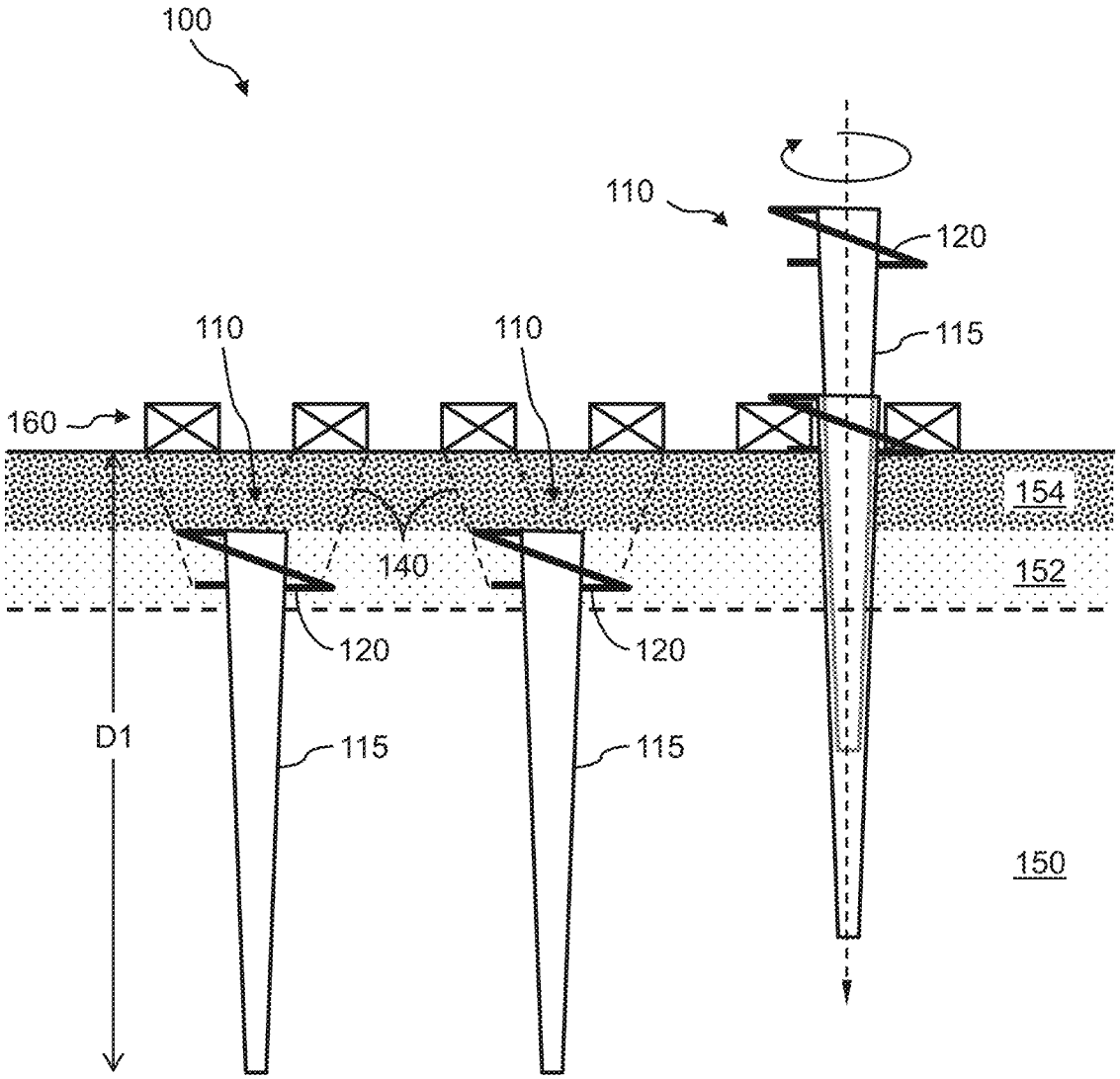
Figure 2A:
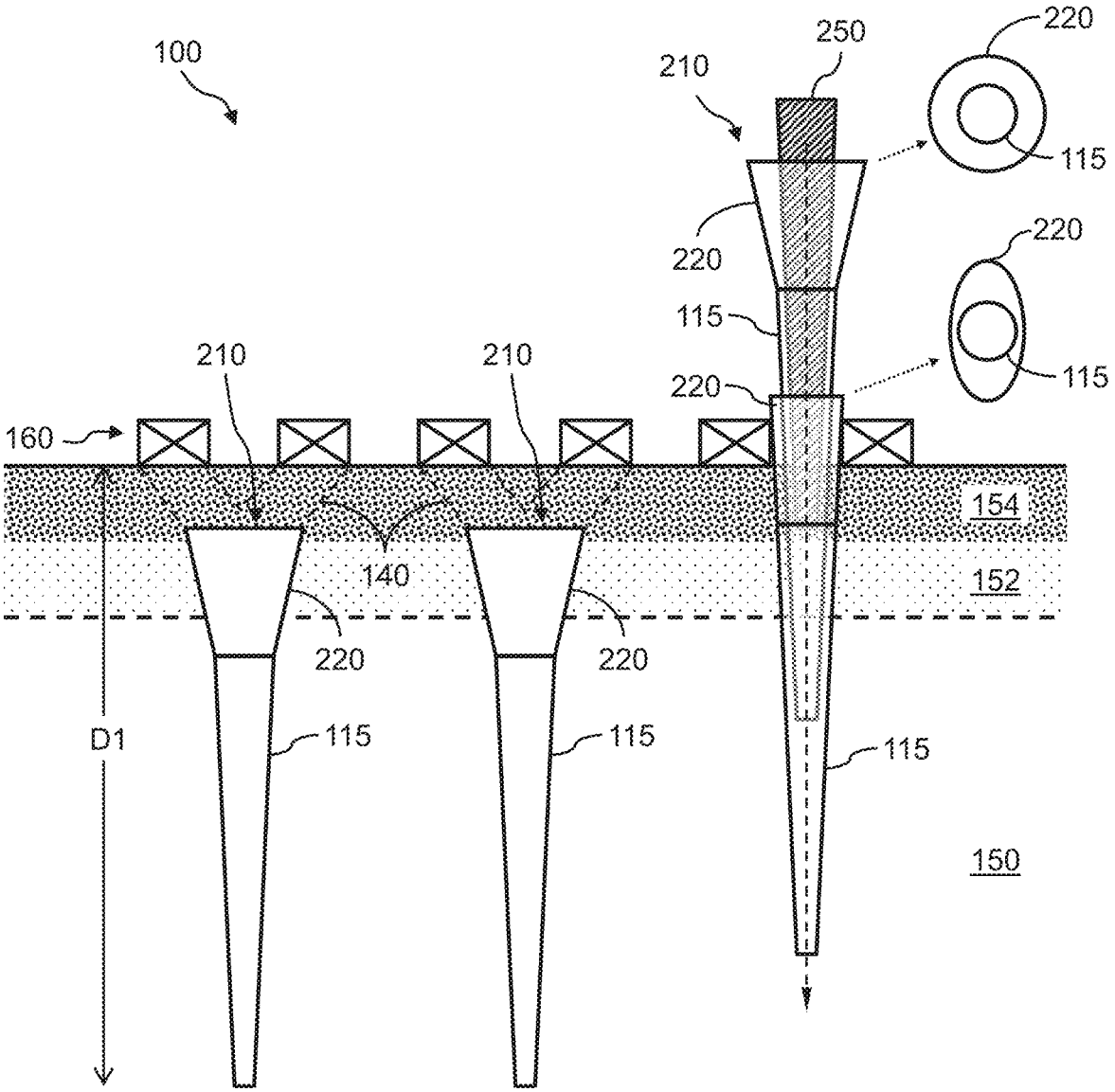
Figure 2B:
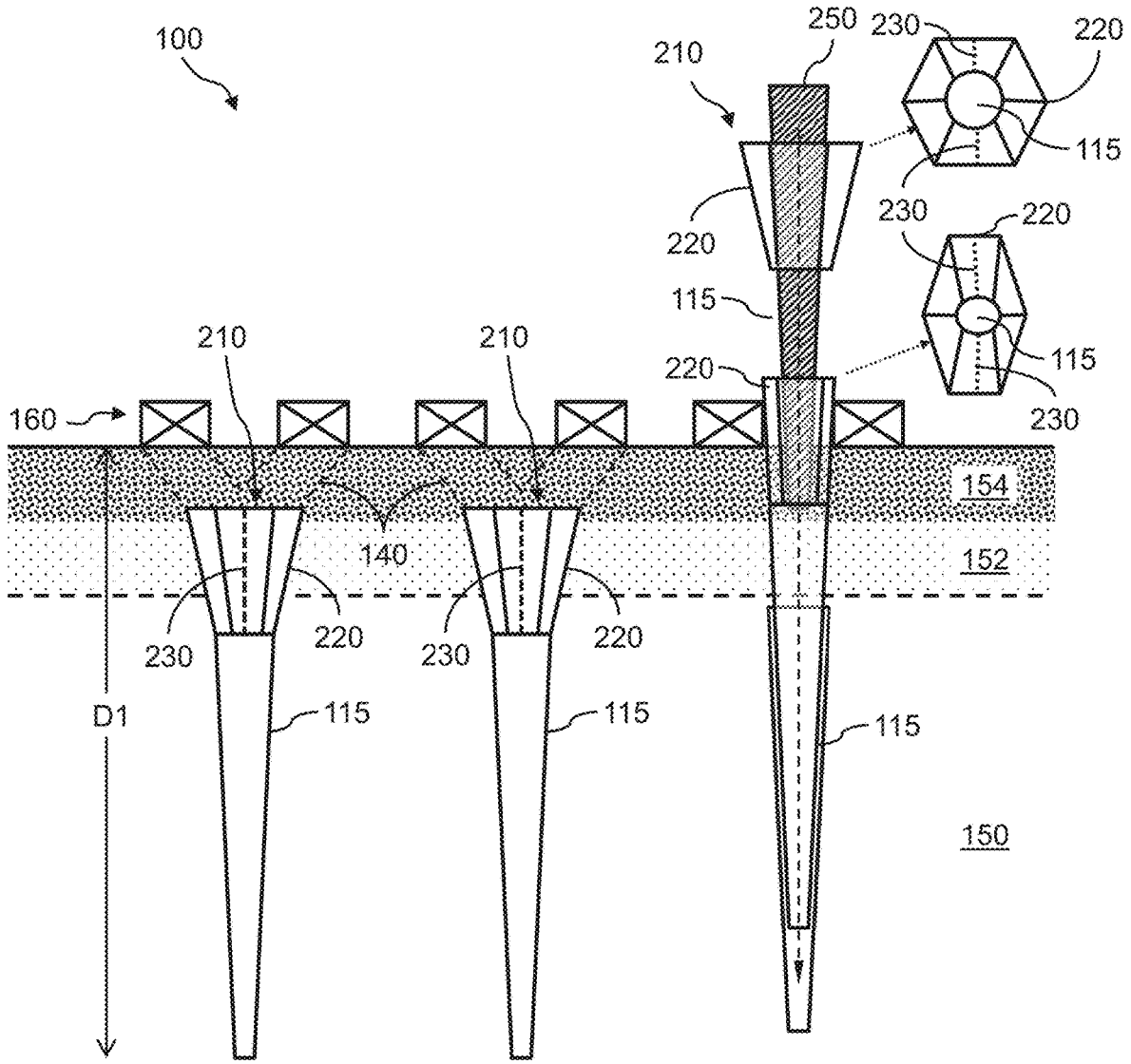
Figure 3:
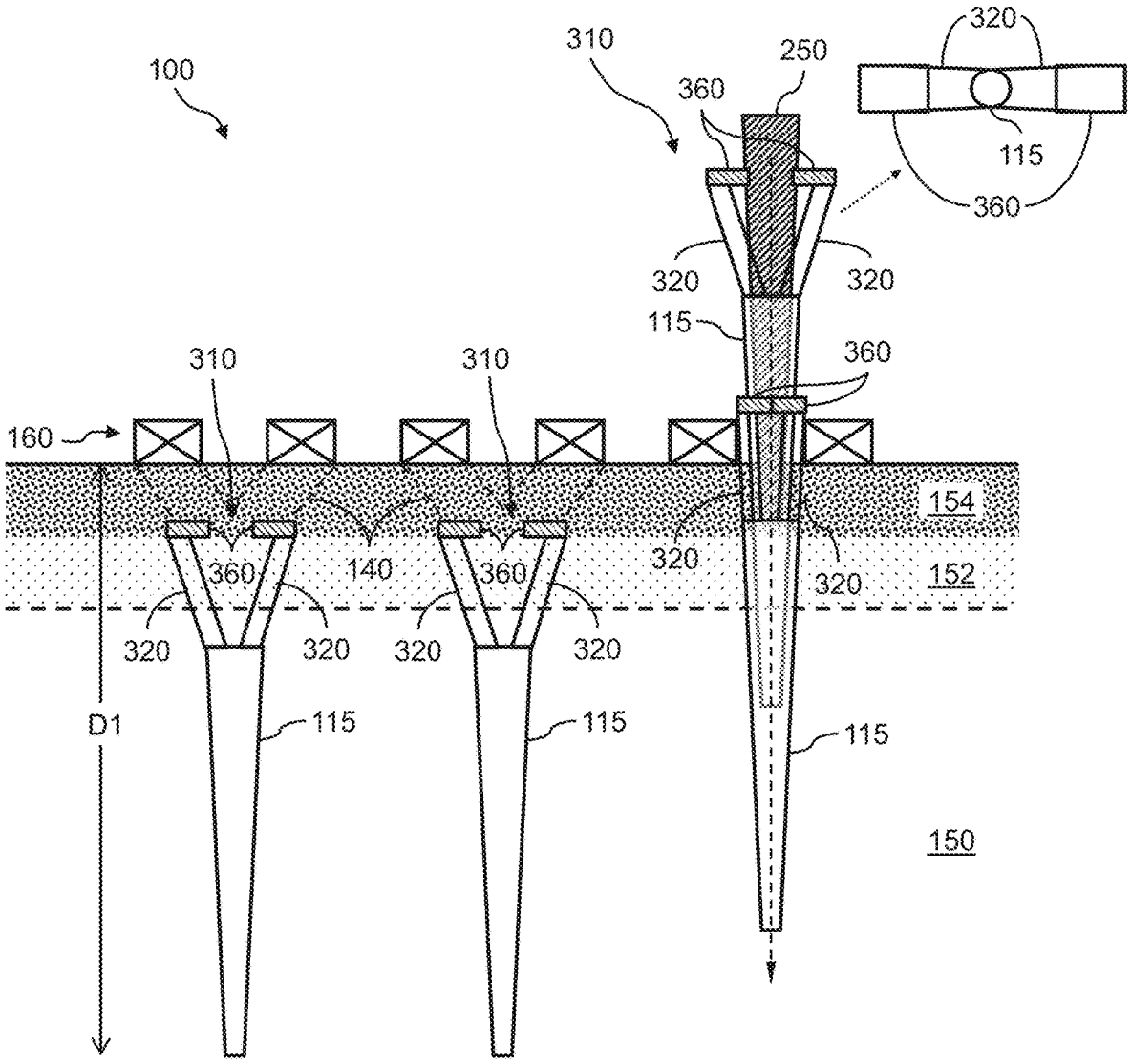
Figure 4:
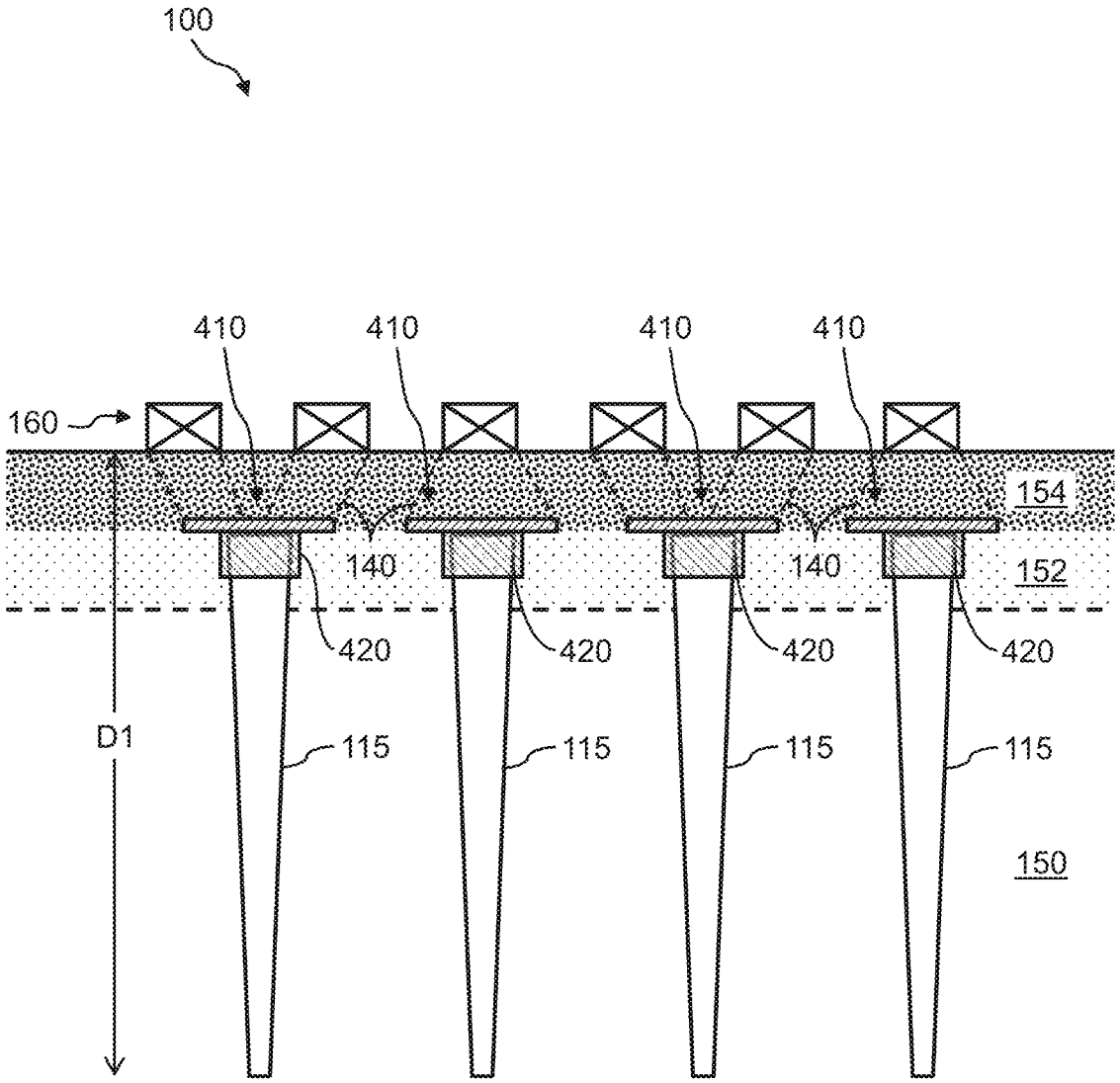
Figure 5:
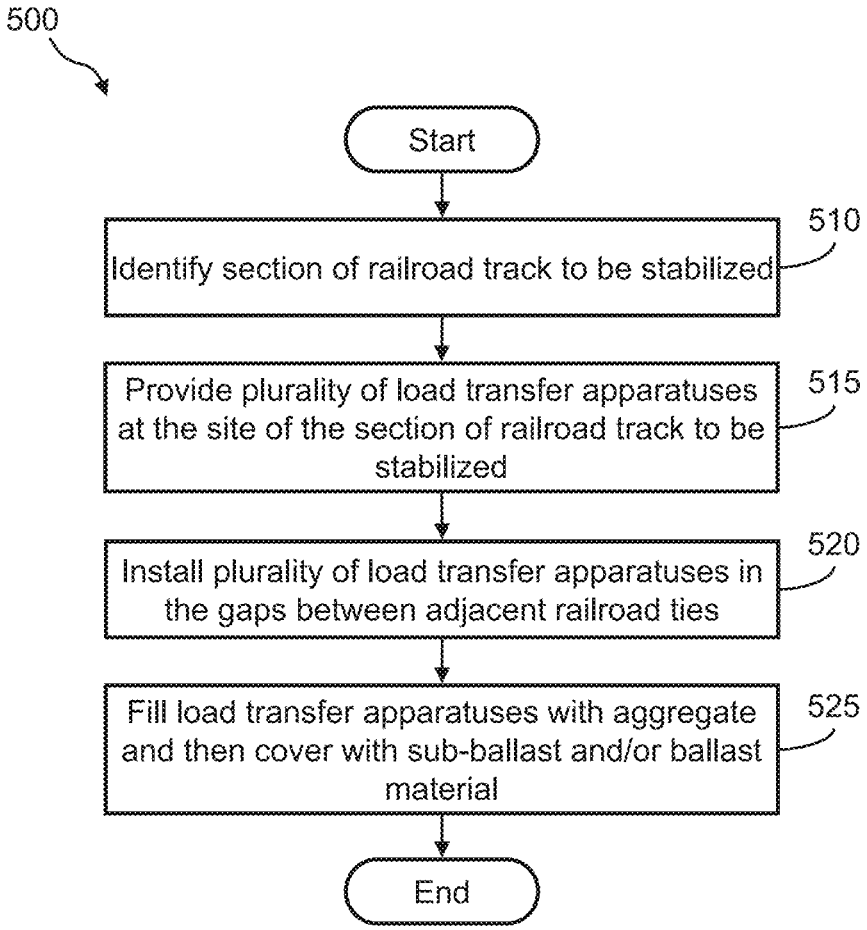
Figure 6:
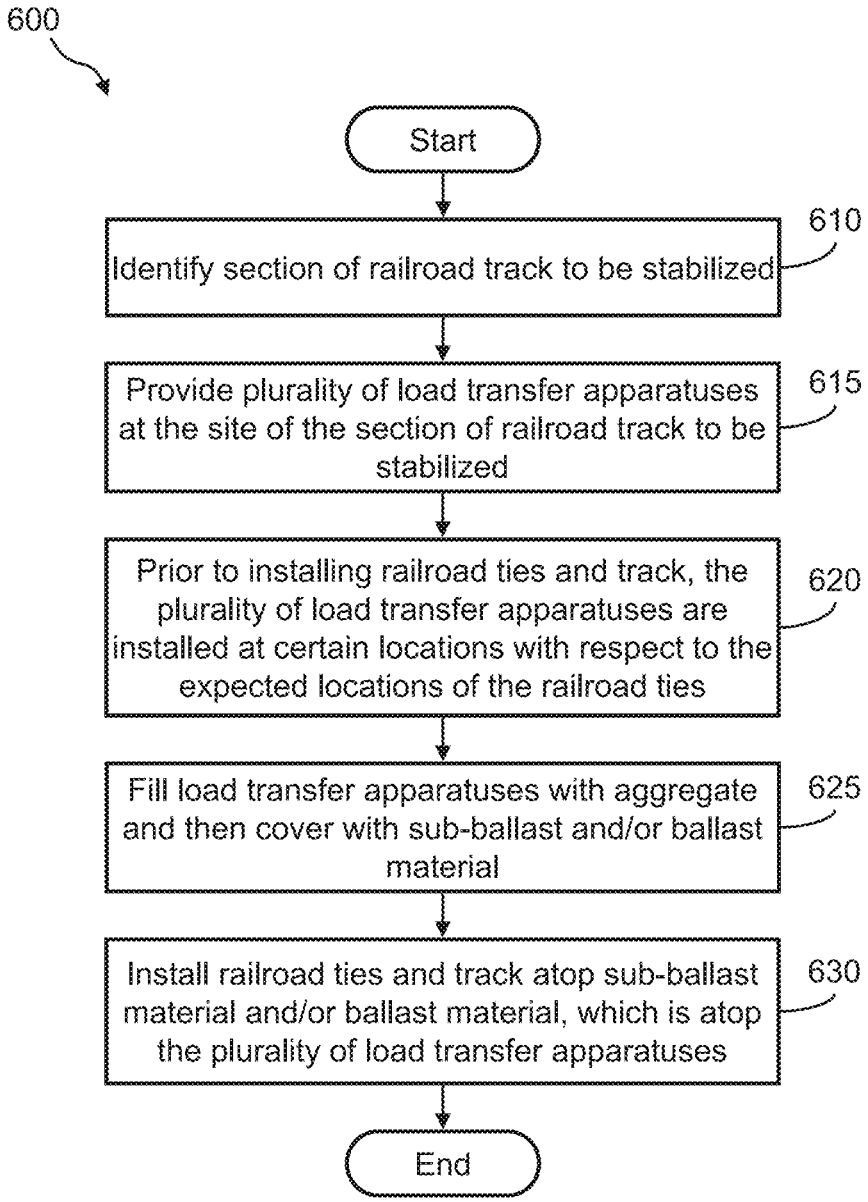
Figure 7:
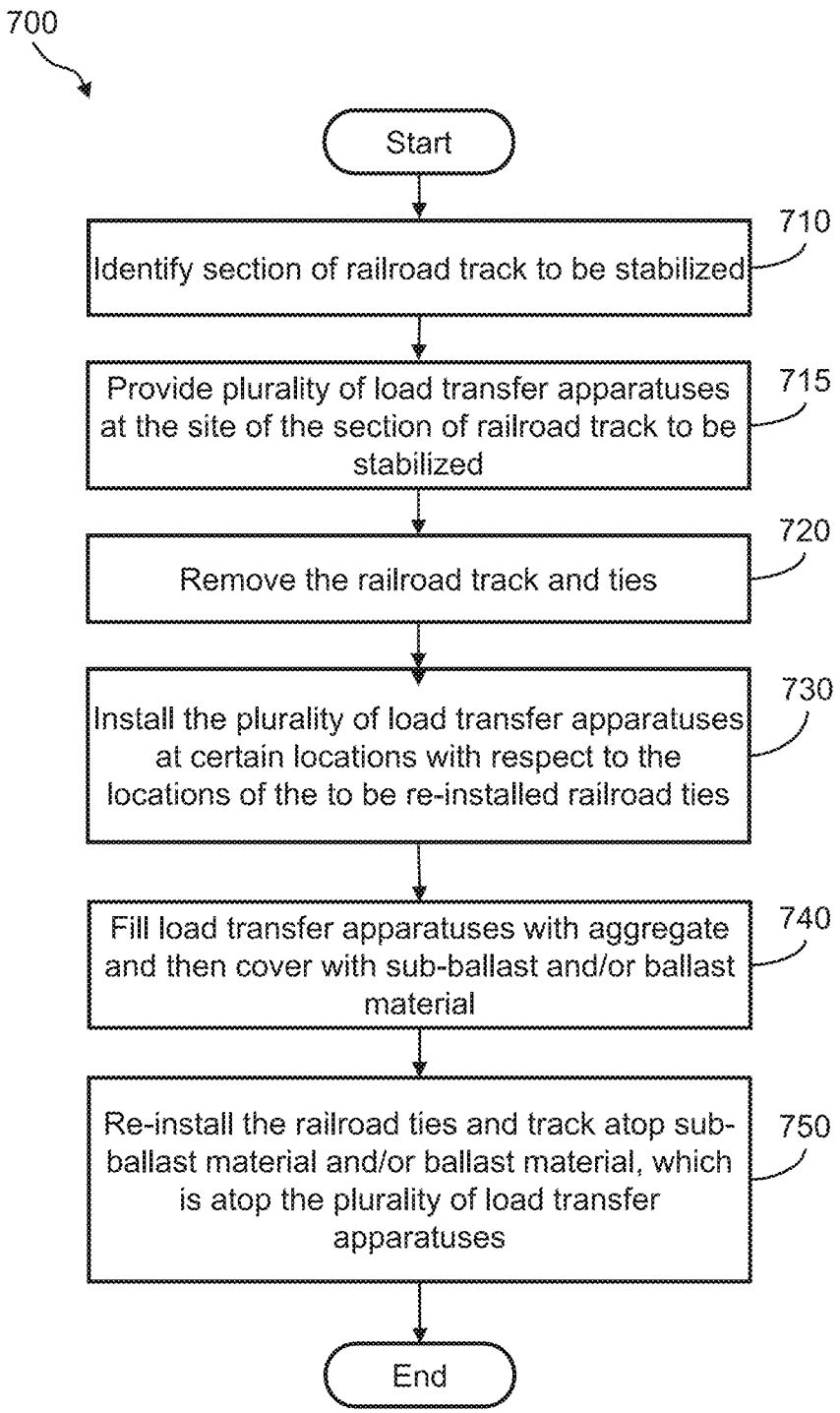

Having thus described the presently disclosed subject matter in general terms, reference will now be made to the accompanying Drawings, which are not necessarily drawn to scale, and wherein:

FIG. 1 illustrates a cross-sectional view of an example of the presently disclosed railroad stabilization system that comprises load transfer apparatuses according to one embodiment;

FIG. 2A illustrates a cross-sectional view of an example of the presently disclosed railroad stabilization system that comprises load transfer apparatuses according to another embodiment;

FIG. 2B illustrates a cross-sectional view of an example of the presently disclosed railroad stabilization system that comprises load transfer apparatuses according to yet another embodiment;

FIG. 3 illustrates a cross-sectional view of an example of the presently disclosed railroad stabilization system that comprises load transfer apparatuses according to yet another embodiment;

FIG. 4 illustrates a cross-sectional view of an example of the presently disclosed railroad stabilization system that comprises load transfer apparatuses according to still another embodiment;

FIG. 5 illustrates a flow diagram of an example of a method of using the load transfer apparatuses with existing railroad tracks to form the railroad stabilization system;

FIG. 6 illustrates a flow diagram of an example of a method of using the load transfer apparatuses with new railroad tracks to form the railroad stabilization system; and FIG. 7 illustrates a flow diagram of an example of a method of using the load transfer apparatuses where existing rail track and associated railroad ties are removed prior to installation of the apparatuses and subsequently re-installed after the apparatuses are installed.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a system for and method of stabilizing rail track structures using a load transfer apparatus. Certain aspects of the presently disclosed subject matter provide a railroad stabilization system. The system may provide one or more load transfer apparatuses arranged in relation to the rail ties of a railroad track. The one or more load transfer apparatuses are each formed by the insertion of a vertical inclusion (i.e., a vertical load transfer element) in the ground between and/or below rail ties and placing a load transfer mechanism between the vertical inclusion and the railroad tie.

The load transfer apparatus typically comprises a vertical load transfer element and a top load transfer element, wherein the top load transfer element may be used to transfer the applied locomotive and rail car loads to the vertical load transfer element. In one embodiment, the top load transfer element includes helical flights, wherein the helical flights are attached to an upper end of the vertical load transfer element when installed. In another embodiment, the top load transfer element includes a flared top, wherein the flared top is attached to the upper end of the vertical load transfer element when installed. In yet another embodiment, the top load transfer element includes a load transfer cap, wherein the load transfer cap is attached to the upper end of the vertical load transfer element when installed. The railroad stabilization system may include any one type or any combinations of types of the aforementioned load transfer apparatuses.

An advantageous aspect of the presently disclosed system, method, and load transfer apparatus is that it is particularly useful for (1) stabilizing active railroad beds that have settled and are desired to remain in operation and (2) increasing track modulus (i.e., rail support stiffness) to improve overall track performance.

Another aspect of the presently disclosed system, method, and load transfer apparatus is it can be installed without great disruption to active rail lines and can be used to effectively support railroad ties and rails by transferring the applied loads through the compressible soils and into the less compressible underlying soils and thereby reduce permanent settlement and deformation under load.

Referring now to FIG. 1, a cross-sectional view of an example of the presently disclosed railroad stabilization system 100 is illustrated that comprises one or more load transfer apparatuses 110 according to one embodiment. As shown in FIG. 1, the existing rail line is constructed over soft subgrade soil 150 that may consist of natural compressible soil, compressible embankment fill materials, materials that have been softened by rainwater or other sources, and/or other compressible soil or materials. A layer of sub-ballast material 152 and a layer of ballast stone material 154 are typically atop the soft subgrade soil 150. The sub-ballast material 152 and the ballast stone material 154 typically include aggregate of varying quality and grain size. The railroad ties 160 are placed on top of the ballast stone material 154, and railroad track (not shown) is placed upon the railroad ties 160.

The presently disclosed railroad stabilization system 100 may be typically installed between and/or underneath the railroad ties 160. The railroad stabilization system 100 includes the one or more load transfer apparatuses 110. Each of the load transfer apparatuses 110 further includes a vertical load transfer element 115 and a top load transfer element (described further below), wherein the top load transfer element is used to transfer the applied locomotive and rail car loads to the vertical load transfer element 115. In the load transfer apparatus 110 shown in FIG. 1, the top load transfer element is helical flights 120. Namely, the helical flights 120 are attached to the upper end of the vertical load transfer element 115 when installed. The helical flights 120 are used to transfer the applied locomotive and rail car loads to the vertical load transfer element 115.

The vertical load transfer element 115 may consist of a variety of vertically oriented loading elements, such as, but not limited to, a concrete pile, a steel pile, a timber pile, or other such vertically oriented elements. These types of vertical load transfer elements are well known in the field and have historically been used to support buildings and other structures.

In the example shown in FIG. 1, the vertical load transfer element 115 may be a polymer shell that can be driven into the ground using an interior mandrel 250 (see FIG. 2). The use of a polymer shell and the method of construction is typical to that described in U.S. Pat. No. 8,221,033 entitled "Extensible Shells and Related Methods for Constructing a Support Pier"; the entire disclosure of which is incorporated herein by reference. The vertical load transfer element 115 can be, for example, from about 3 inches (7.6 cm) to about 12 inches (30.5 cm) in diameter. However, so that the vertical load transfer element 115 may fit in between the edges of adjacent existing railroad ties 160 when driven from grade, the diameter of the vertical load transfer element 115 is most often from about 4 inches (10.1 cm) to about 8 inches (20.3 cm). Further, the vertical load transfer element 115 may be tapered wherein the distal end has a smaller diameter than the proximal end. Additionally, the length of the vertical load transfer element 115 can be, for example, from about 3 feet (0.9 m) to about 12 feet (3.7 m), or about 8 feet (2.4 m) in certain embodiments. The thickness of the sidewalls of the polymer shell can be, for example, from about 0.1 inches (0.3 cm) to about 0.4 inches (1.0 cm), and may vary along the length of the vertical load transfer elements (e.g., the sidewall may be thicker at the bottom end of the element relative to the top. Note, however, that the length, diameter, and wall thickness of the vertical load transfer elements may be any other appropriate dimension, and that the wall thickness may vary with length.

In the vertical load transfer element 115, the helical flights 120 may be integral to the sidewalls of the vertical load transfer element 115. The helical flights 120 can be formed, for example, of metal or polymer and may have a thickness of, for example, from about 0.1 inches (0.3 cm) to about 0.4 inches (1.0 cm). Further, the overall diameter of the helical flights 120 can be, for example, from about 8 inches (20.3 cm) to about 16 inches (40.6 cm).

In some embodiments, the load transfer apparatus 110 may be twisted into the ground much like a wood screw is turned into a wooden block. The pitch and width of the helical flights 120 are typically configured so that when rotated, the helical flights 120 twist between the adjacent railroad ties 160 much like a machine screw twists into a predrilled surface defined by the diameter of the shaft of the screw. Accordingly, the vertical load transfer element 115 can be twisted into the ground and halted at depth below the bottom of the railroad ties 160. This twisting process may be utilized both with and without a pre-drilled cavity configured to receive the load transfer apparatus 110, depending on ground conditions, etc. The depth D1 below the bottom of the railroad ties 160 can range, for example, from about 3 feet (0.9 m) to about 20 feet (6.1 m). The depth may also be reduced or extended further, if appropriate. Once twisted into the ground, the vertical load transfer element 115 (e.g., the polymer shell) may be filled with aggregate to maintain the engagement of the sidewalls of the shell with the surrounding ground and assist in load transfer.

In operation, when vertical loads are applied to the railroad ties 160, the loads are transferred downward (through arching action 140 in the sub-ballast material 152 and/or the ballast stone material 154) to the tops of the helical flights 120 and then to the vertical load transfer elements 115. In this example, the width of the helical flights 120 spans at least a portion of two adjacent railroad ties 160. Further, in the railroad stabilization system 100 shown in FIG. 1, the load transfer apparatuses 110 may be installed in an existing railroad track or may be installed during railroad bed rehabilitation (e.g., railroad ties 160 are removed and replaced to allow installation of vertical load transfer elements 115) and when building a new railroad track (e.g., prior to the installation of the railroad ties 160 and track). The railroad stabilization system 100 may have vertical load elements 115 installed immediately below the rail of the railroad track, substantially outside or inside of the rail but below the railroad ties 160, or in an alternating fashion, where the vertical load elements are installed alternatingly inside and outside the rail.

Referring now to FIG. 2A and FIG. 2B, cross-sectional views of examples of the presently disclosed railroad stabilization system 100 are illustrated that include one or more load transfer apparatuses 210 according to another embodiment. Again, the railroad stabilization system 100 is typically installed between and/or underneath the railroad ties 160.

The load transfer apparatus 210 is substantially the same as the load transfer apparatus 110 shown and described in FIG. 1 except that the top load transfer element is a flared top 220 instead of the helical flights 120. The flared top 220 is attached to the upper end of the vertical load transfer element 115 when installed. The flared top 220 is used to transfer the applied locomotive and rail car loads to the vertical load transfer element 115.

Instead of twisting into the ground, the vertical load transfer element 115 may be a polymer shell that can be driven into the ground using, for example, an interior mandrel 250. In one example, the interior mandrel 250 may extend through the interior of the flared top 220 and the vertical load transfer element 115 to drive the shell by engaging the bottom and/or sides of the vertical load transfer element 115. In another example, the interior mandrel 250 is engaged to the top edge of the flared top 220 and used to drive the top of the flared top 220 and the vertical load transfer element 115 into the ground. In another example, the interior mandrel 250 is used to first drive the vertical load transfer element 115 into the ground, then the flared top 220 is installed at the upper end of the vertical load transfer element 115. Once driven into the ground, the vertical load transfer element 115 (e.g., the polymer shell) and the flared top 220 may be filled with aggregate (or other suitable material) to maintain the engagement of the sidewalls of the shell with the surrounding ground and assist in load transfer.

In the load transfer apparatus 210, the flared top 220 can be constructed of flexible materials, such as, but not limited to, steel, aluminum, other metals or composite materials, or plastic, that "squeezes" between the railroad ties 160 when driven downward and expands radially outward when the load transfer apparatus 210 is filled with backfill material (e.g., aggregate) that may be compacted therein. For example, FIG. 2A shows one of the load transfer apparatuses 210 during the installation process. In its natural state, the flared top 220 may be a substantially circular shape. In another embodiment, shown in FIG. 2B, the flared top 220 may be an articulated shape (e.g., a six-sided articulated shape). However, because of the flexibility of the flared top 220, when passing between two adjacent railroad ties 160, the flared top 220 may deform to a more ovalized shape and then expand back to its original substantially circular or articulated shape once below the railroad ties 160 (and filled/compacted with aggregate). The flared top 220 may also include one or more slots 230 to aid in deformation. The load transfer apparatus 210 can be installed to a depth D1 below the bottom of the railroad ties 160 of, for example, from about 3 feet (0.9 m) to about 20 feet (6.1 m). Accordingly, in the railroad stabilization system 100 shown in FIG. 2A and FIG. 2B, the load transfer apparatuses 210 can be installed in an existing railroad track or may be installed when building a new railroad track (e.g., prior to the installation of the railroad ties 160 and track).

In operation, when vertical loads are applied to the railroad ties 160, the loads are transferred downward (through arching action 140 in the sub-ballast material 152 and/or the ballast stone material 154) to the tops of the flared tops 220 and then to the vertical load transfer elements 115. In this example, the width of the flared top 220 spans at least a portion of two adjacent railroad ties 160.

Referring now to FIG. 3, a cross-sectional view of an example of the presently disclosed railroad stabilization system 100 is illustrated that comprises one or more load transfer apparatuses 310 according to yet another embodiment. Again, the railroad stabilization system 100 is typically installed between and/or underneath the railroad ties 160.

The load transfer apparatus 310 includes at least two support legs 320, and further includes a top support 360 attached to a top portion of each support leg 320. The support legs 320 and their corresponding top supports 360 couple to the upper end of vertical load transfer element 115. The support legs 320 and their corresponding top supports 360 are used to transfer the applied locomotive and rail car loads to the vertical load transfer element 115.

Like the load transfer apparatus 210 shown in FIG. 2A and FIG. 2B, load transfer apparatus 310 can be constructed of flexible material such as, but not limited to, steel, aluminum, other metals or composite materials, or plastic, that "squeezes" between the railroad ties 160 when driven downward. Once driven between the railroad ties 160, the load transfer apparatus 310 can return to its original expanded position, particularly when filled/compacted with aggregate.

Referring now to FIG. 4, a cross-sectional view of an example of the presently disclosed railroad stabilization system 100 is illustrated that comprises one or more load transfer apparatuses 410 according to yet another embodiment. Again, the railroad stabilization system 100 is typically installed between and/or underneath the railroad ties 160.

The load transfer apparatus 410 is substantially the same as the load transfer apparatus 110 shown and described in FIG. 1 except that the top load transfer element is a load transfer cap 420 instead of the helical flights 120. Accordingly, the load transfer cap 420 is attached to the upper end of the vertical load transfer element 115 when installed. The load transfer cap 420 is used to transfer the applied locomotive and rail car loads to the vertical load transfer element 115.

Instead of twisting into the ground, the vertical load transfer element 115 may be a metal or polymer shell that can be driven or placed into the ground using, for example, the interior mandrel 250. In one example, the interior mandrel 250 may extend through the interior of the vertical load transfer element 115 to drive the shell by engaging the bottom and/or sides of the vertical load transfer element 115. Once driven into the ground, the vertical load transfer element 115 (e.g., the polymer shell) may be filled with aggregate to maintain the engagement of the sidewalls of the shell with the surrounding ground and assist in load transfer, then the load transfer cap 420 may be installed at the upper end of the vertical load transfer element 115.

The load transfer cap 420 may be constructed, for example, of steel, concrete, aluminum, other metals, plastic, wood, composite materials, or other materials that can transfer shear and bending stresses from the railroad ties 160 and the zone of arching action 140 to the top of the vertical load transfer element 115. The load transfer cap 420 is typically larger in diameter than the top of the vertical load transfer element 115 to "catch" the arched stresses and transfer them to the vertical load transfer element 115. Additionally, the load transfer cap 420 can be formed with an upward "lip" or rim (not shown) around the perimeter to act as a lateral restraint to aggregate placed on top of the load transfer cap 420. This restraint can increase the stress concentration and stress arching to the load transfer cap 420.

In operation, when vertical loads are applied to the railroad ties 160 the loads are transferred downward (through arching action 140 in the sub-ballast material 152 and/or the ballast stone material 154) to the tops of the load transfer caps 420 and then to the vertical load transfer elements 115. In this example, the width of the load transfer cap 420 can span all or a portion of the width of one railroad tie 160 or can span at least a portion of two adjacent railroad ties 160. Further, in the railroad stabilization system 100 shown in FIG. 4, the load transfer apparatuses 410 can be installed when rehabilitating an existing railroad track (e.g., ties are removed and replaced to allow installation of vertical load transfer elements) and when building a new railroad track (e.g., prior to the installation of the railroad ties 160 and track).

Referring now to FIG. 1, FIG. 2A, FIG. 2B, FIG. 3, and FIG. 4, in the railroad stabilization system 100, the number and frequency of placement of the load transfer apparatuses 110, 210, 310, and 410 can vary depending on the size of the load transfer apparatus 110, 210, 310, 410. With respect to the line of railroad ties 160, the load transfer apparatus 110, 210, 310, 410 can be sized such that one load transfer apparatus 110, 210, 310, 410 is installed between adjacent railroad ties 160; albeit multiple load transfer apparatuses 110, 210, 310, 410 can be installed in a single gap between any two adjacent railroad ties 160 (i.e., along the length of the railroad ties 160). Additionally, the load transfer apparatus 110, 210, 310, 410 can be installed directly beneath the respective railroad ties 160, or a combination of both between and beneath the railroad ties 160. Further, for relatively small diameter load transfer apparatuses 110, 210, 310, 410, in order to efficiently transfer the train loads (i.e., the loads applied by the locomotive and rail cars to the railroad ties 160) to the vertical load transfer elements 115, it may be necessary to install several tightly spaced load transfer apparatuses 110, 210, 310, 410.

FIG. 5 illustrates a flow diagram of an example of a method 500 of using the load transfer apparatuses 110, 210, 310 and/or 410 with existing railroad tracks or rehabilitation of an existing railroad track where ties are removed and replaced to allow installation of vertical load transfer elements to form the railroad stabilization system 100. The method 500 may include, but is not limited to, the following steps.

At a step 510, a section of railroad track to be stabilized is identified.

At a step 515, a plurality of the load transfer apparatuses 110, 210, 310, and/or 410 are provided at the site of the section of railroad track to be stabilized.

At a step 520, the plurality of load transfer apparatuses 110, 210, 310, and/or 410 are installed in the gaps between adjacent railroad ties 160. In the case of the load transfer apparatus 110, for each load transfer apparatus 110 to be installed, a hole may be drilled in the soil material between and below the railroad ties 160 to assist in insertion of the load transfer apparatus 110 or the load transfer apparatus 110 can otherwise be inserted into the soil (such as with a mandrel 250). Then, each of the load transfer apparatuses 110 is twisted into the ground to a certain depth below the railroad ties 160. In the case of the load transfer apparatus 210 or 310, each of the load transfer apparatuses 210 or 310 is driven into the ground (e.g., using the interior mandrel 250) to a certain depth below the railroad ties 160. In the case of load transfer apparatuses 410, the railroad ties may be removed and replaced to allow each of the vertical load transfer elements 115 (without the load transfer caps 420) to be driven into the ground (e.g., using the interior mandrel 250) to a certain depth below the railroad tie location.

At a step 525, the plurality of load transfer apparatuses 110, 210, 310, and/or 410 are filled with aggregate (or other suitable material) and then covered with the sub-ballast material 152 and/or the ballast stone material 154. In the case of the load transfer apparatuses 410, the vertical load transfer elements 115 may be filled with aggregate and then the load transfer caps 420 installed thereon. Then, the load transfer apparatuses 410 may be covered with the sub-ballast material 152 and/or the ballast stone material 154.

FIG. 6 illustrates a flow diagram of an example of a method 600 of using the load transfer apparatuses 110, 210, 310, and/or 410 with new or rehabilitated railroad tracks to form the railroad stabilization system 100. The method 600 may include, but is not limited to, the following steps.

At a step 610, a section of railroad track to be stabilized is identified.

At a step 615, a plurality of the load transfer apparatuses 110, 210, 310, and/or 410 are provided at the site of the section of railroad track to be stabilized.

At a step 620, prior to the installation of the railroad ties 160 and track, the plurality of load transfer apparatuses 110, 210, 310, and/or 410 are installed at certain locations with respect to the expected locations of the railroad ties 160. In the case of the load transfer apparatus 110, for each load transfer apparatus 110 to be installed, a hole may be drilled in the soil material at a certain location with respect to the expected location of a corresponding railroad tie 160 to assist in insertion, or the load transfer apparatus 110 can otherwise be inserted into the soil (such as with a mandrel 250). Then, each of the load transfer apparatuses 110 is twisted into the ground to a certain depth below the expected location of a corresponding railroad tie 160. In the case of the load transfer apparatus 210 or 310, each of the load transfer apparatuses 210 or 310 is driven into the ground (e.g., using the interior mandrel 250) to a certain depth below the railroad ties 160. In the case of the load transfer apparatus 410, each of the vertical load transfer elements 115 (without the load transfer caps 420) is driven into the ground (e.g., using the interior mandrel 250) to a certain depth below the railroad ties 160.

At a step 625, the plurality of load transfer apparatuses 110, 210, 310, and/or 410 are filled with aggregate (or other suitable material) and then covered with the sub-ballast material 152 and/or the ballast stone material 154. In the case of the load transfer apparatuses 410, the vertical load transfer elements 115 may be filled with aggregate and then the load transfer caps 420 installed thereon. Then, the load transfer apparatuses 410 may be covered with the sub-ballast material 152 and/or the ballast stone material 154.

At a step 630, the railroad ties 160 and railroad track are installed atop the sub-ballast material 152 and/or the ballast stone material 154, which is atop the plurality of load transfer apparatuses 110, 210, 310, and/or 410.

FIG. 7 illustrates a flow diagram of an example of a method 700 of using the load transfer apparatuses 110, 210, 310, and/or 410 in an existing railroad track bed forming the railroad stabilization system 100. The method 700 may include, but is not limited to, the following steps:

At a step 710, a section of railroad track to be stabilized is identified.

At a step 715, a plurality of the load transfer apparatuses 110, 210, 310, and/or 410 are provided at the site of the section of railroad track to be stabilized.

At a step 720, the railroad track and associated railroad ties 160 of the existing railroad track bed are removed.

At a step 730, the plurality of the load transfer apparatus 110, 210, 310, and/or 410 are installed at certain locations with respect to the locations where the railroad ties 160 are to be re-installed. In the case of the load transfer apparatus 110, for each load transfer apparatus 110 to be installed, a hole may be drilled in the soil material to assist in insertion at a certain location with respect to the expected location of a corresponding railroad tie 160 that will be re-installed, or the load transfer apparatus 110 can otherwise be inserted into the soil (such as with a mandrel 250). Then, each of the load transfer apparatuses 110 may be twisted into the ground to a certain depth below the expected location of a corresponding railroad tie 160. In the case of the load transfer apparatus 210 or 310, each of the load transfer apparatuses 210 or 310 may be driven into the ground (e.g., using the interior mandrel 250) to a certain depth below the expected location of the railroad ties 160 to be re-installed. In the case of the load transfer apparatus 410, each of the vertical load transfer elements 115 (without the load transfer caps 420) may be driven into the ground (e.g., using the interior mandrel 250) to a certain depth below the expected location of the railroad ties 160 to be re-installed.

At a step 740, the plurality of load transfer apparatuses 110, 210, 310, and/or 410 are filled with aggregate (or other suitable material) and then covered with the sub-ballast material 152 and/or the ballast stone material 154. In the case of the load transfer apparatuses 410, the vertical load transfer elements 115 may be filled with aggregate and then the load transfer caps 420 installed thereon. Then, the load transfer apparatuses 410 may be covered with the sub-ballast material 152 and/or the ballast stone material 154.

At a step 750, the railroad ties 160 and railroad track are re-installed atop the sub-ballast material 152 and/or the ballast stone material 154, which is atop the plurality of load transfer apparatuses 110, 210, and/or 310.

Referring now to FIG. 1 through FIG. 7, the presently disclosed railroad stabilization system 100; methods 500, 600, 700; and load transfer apparatuses 110, 210, 310, 410 are particularly useful for (1) stabilizing active railroad beds that have settled and are desired to remain in operation and (2) increasing track modulus (i.e., rail support stiffness) to improve overall track performance.

Further, the presently disclosed railroad stabilization system 100; methods 500, 600, 700; and load transfer apparatuses 110, 210, 310, 410 can be installed without great disruption to active rail lines and can be used to effectively support railroad ties and rails by transferring the applied loads through the compressible soils and into the less compressible underlying soils and thereby reduce permanent settlement and deformation under load.

Additionally, the presently disclosed railroad stabilization system 100; methods 500, 600, 700; and load transfer apparatuses 110, 210, 310, 410 provide the advantage of being efficiently constructed from existing grade at minimal disruption to active rail lines to actively transfer rail loads through soft and compressible materials and into firm materials. The railroad stabilization system 100; methods 500, 600, 700; and load transfer apparatuses 110, 210, 310, 410 provide great economic benefit to active railroads because it can be used to quickly stabilizing deficient lines, increase allowable rail speeds, and reduce maintenance costs.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A system for stabilizing railroad ties and rails, the system comprising:

a) a vertical load transfer element; and b) a top load transfer element wherein the top load transfer element comprises a flared top attached to an upper portion of the vertical load transfer element and further wherein the flared top is configured to be compressible to a substantially oval shape when driven between the railroad ties and is configured to be subsequently expandable to the flared top's substantially original shape once driven below the railroad ties; and wherein the vertical load transfer element and top load transfer element transfer the load applied to the railroad ties and rails to less compressible underlying soils.

2. The system of claim 1 wherein the vertical load transfer element comprises a pile.

3. The system of claim 2 where the pile comprises any one of a concrete pile, steel pile, timber pile, or composite pile.

4. The system of claim 1 wherein the vertical load transfer element comprises an extensible shell defining an interior for holding granular construction material and defining an opening for receiving the granular construction material into the interior, wherein the shell is flexible such that the shell expands laterally outward when granular construction material is compacted in the interior of the shell.

5. The system of claim 4 wherein the extensible shell has a diameter in the range of 3 to 12 inches (7.6 to 30.5 cm).

6. The system of claim 1 wherein the top load transfer element comprises helical flights attached to an upper portion of the vertical load transfer element.

7. The system of claim 6 wherein the helical flights of the top load transfer element comprise a pitch and width configured depending on the size and spacing of the railroad ties.

8. The system of claim 1 wherein the top load transfer element comprises a load transfer cap attached to an upper portion of the vertical load transfer element.

9. The system of claim 8 wherein the load transfer cap is constructed of a material comprising any one of steel, concrete, aluminum, other metals, plastic, wood, or composite materials.

10. The system of claim 8 wherein the load transfer cap has a diameter larger than a diameter of the vertical load transfer element.

11. The system of claim 8 wherein the load transfer cap further comprises an upwardly projecting lip around a perimeter thereof for acting as a lateral restraint.

12. The system of claim 1 wherein the top load transfer element extends in a horizontal direction away from a vertical axis of the vertical load transfer element.

13. The system of claim 12 wherein the flared top is substantially circular.

14. The system of claim 12 wherein the flared top comprises an articulated shape.

15. The system of claim 12 wherein the flared top is constructed of a flexible material.

16. The system of claim 15 wherein the flexible material comprises any one of steel, aluminum, other metals, plastic, or composite materials.

17. The system of claim 12 wherein the flared top further comprises one or more vertical slots.

18. The system of claim 1 wherein the top load transfer element comprises two or more support legs each with a top support attached thereto.

19. The system of claim 18 wherein the top load transfer element is constructed of a flexible material.

20. The system of claim 19 wherein the flexible material comprises any one of steel, aluminum, other metals, plastic, or composite materials.

21. A method of stabilizing existing rail track structures, the method comprising:

a) identifying a section of rail track structure to be stabilized;

b) providing one or more load transfer apparatuses of a system for stabilizing railroad ties and rails according to claim 1, wherein the one or more load transfer apparatuses comprises a vertical load transfer element and a top load transfer element;

c) installing the one or more load transfer apparatuses in one or more gaps between adjacent railroad ties within the rail track structure; and d) compressing the flared top to a substabtially oval shape when driven between the railroad ties and subsequently expanding the flared top to the flared top's substantially original shape once driven below the railroad ties.

22. The method of claim 21 wherein the one or more load transfer apparatuses comprise an extensible shell defining an interior for holding granular construction material and defining an opening for receiving the granular construction material into the interior and further including the step of filling the load transfer apparatuses with granular material and compacting the material.

23. A method of stabilizing a rail track structure, the method comprising:

a) identifying an area to be stabilized on which a railroad track and associated railroad ties will be installed;

b) providing one or more load transfer apparatuses of a system for stabilizing railroad ties and rails according to claim 1, wherein the one or more load transfer apparatuses comprises a vertical load transfer element and a top load transfer element;

c) installing the one or more load transfer apparatuses prior to installing the railroad ties and track, wherein the one or more load transfer apparatuses are installed at certain locations relative to expected locations of the railroad ties; and d) installing the railroad ties and track atop the one or more load transfer apparatuses.

24. The method of claim 23 wherein the one or more load transfer apparatuses comprise an extensible shell defining an interior for holding granular construction material and defining an opening for receiving the granular construction material into the interior and further including the step of filling the load transfer apparatuses with granular material and compacting the material.

25. A method of stabilizing a rail track structure, the method comprising:

a) identifying an area of railroad track and associated railroad ties to be stabilized;

b) providing one or more load transfer apparatuses of a system for stabilizing railroad ties and rails according to claim 1, wherein the one or more load transfer apparatuses comprises a vertical load transfer element and a top load transfer element;

c) removing the railroad track and associated railroad ties;

d) installing the one or more load transfer apparatuses wherein the one or more load transfer apparatuses are installed at certain locations relative to expected locations of the railroad ties to be re-installed; and e) re-installing the railroad ties and track atop the one or more load transfer apparatuses.

26. The method of claim 25 wherein the one or more load transfer apparatuses comprise an extensible shell defining an interior for holding granular construction material and defining an opening for receiving the granular construction material into the interior and further including the step of filling the load transfer apparatuses with granular material and compacting the material.

* * * * *